US009447340B2

(12) United States Patent
Olliges

(10) Patent No.: US 9,447,340 B2
(45) **Date of Patent: *Sep. 20, 2016**

(54) HEXYLENE GLYCOL FUEL ADDITIVE CONTAINING BORIC ACID FOR INHIBITING PHASE SEPARATION AND CORROSION IN ETHANOL BLENDED FUELS

(76) Inventor: William E. Olliges, Palm City, FL (US)

( * ) Notice: Subject to any disclaimer, the term of this patent is extended or adjusted under 35 U.S.C. 154(b) by 1052 days.

This patent is subject to a terminal disclaimer.

(21) Appl. No.: 13/421,108

(22) Filed: Mar. 15, 2012

(65) Prior Publication Data

US 2013/0239462 A1 Sep. 19, 2013

(51) Int. Cl.

| | |
|---|---|
| ***C10L 1/18*** | (2006.01) |
| ***C10L 1/12*** | (2006.01) |
| ***C10L 1/30*** | (2006.01) |
| ***C10L 1/04*** | (2006.01) |
| ***C10L 1/10*** | (2006.01) |
| ***C10L 10/04*** | (2006.01) |
| ***C10L 10/08*** | (2006.01) |
| ***C10L 1/02*** | (2006.01) |
| ***C10L 1/32*** | (2006.01) |
| *C10L 10/02* | (2006.01) |

(52) U.S. Cl.

CPC .. *C10L 1/04* (2013.01); *C10L 1/02* (2013.01); *C10L 1/10* (2013.01); *C10L 1/1291* (2013.01); *C10L 1/328* (2013.01); *C10L 10/04* (2013.01); *C10L 10/08* (2013.01); *C10L 10/02* (2013.01); *C10L 2200/0423* (2013.01); *C10L 2270/02* (2013.01)

(58) Field of Classification Search

CPC ..... C10L 1/1291; C10L 1/1826; C10L 1/04; C10L 1/02; C10L 1/10; C10L 1/182; C10L 1/328; C10L 10/02; C10L 10/04; C10L 10/08; C10L 2200/0423; C10L 2270/02

USPC ..... 44/308, 318, 319

See application file for complete search history.

(56) References Cited

U.S. PATENT DOCUMENTS

| | | | | |
|---|---|---|---|---|
| 2,655,454 | A * | 10/1953 | Farber | A01N 61/02 106/164.4 |
| 2,795,548 | A * | 6/1957 | Thomas | C07F 5/04 252/389.41 |
| 2,929,695 | A * | 3/1960 | Faris, Jr. et al. | 44/318 |
| 3,848,312 | A * | 11/1974 | Kirkham | 419/28 |
| 4,753,661 | A * | 6/1988 | Nelson et al. | 44/309 |
| 6,368,369 | B1 | 4/2002 | Sanduja et al. | |
| 6,645,262 | B1 | 11/2003 | Sanduja et al. | |
| 7,419,515 | B2 | 9/2008 | Olliges | |
| 7,494,959 | B2 | 2/2009 | Olliges | |
| 7,598,210 | B2 | 10/2009 | Olliges | |
| 7,972,393 | B2 | 7/2011 | Olliges | |
| 2007/0021310 | A1 | 1/2007 | Olliges et al. | |
| 2007/0033862 | A1 | 2/2007 | Olliges | |
| 2007/0037714 | A1 | 2/2007 | Olliges | |
| 2007/0056213 | A1* | 3/2007 | French | C10L 1/02 44/385 |
| 2008/0200356 | A1 | 8/2008 | Oiilges | |
| 2011/0015104 | A1 | 1/2011 | Olliges | |
| 2011/0036262 | A1 | 2/2011 | Olliges et al. | |

FOREIGN PATENT DOCUMENTS

| | | |
|---|---|---|
| WO | WO0153435 | 7/2001 |

* cited by examiner

*Primary Examiner* — Latosha Hines
(74) *Attorney, Agent, or Firm* — McHale & Slavin P.A.

(57) ABSTRACT

The present invention relates to a fuel additive formulation that is designed to inhibit and/or reverse phase separation in Ethanol Blended Fuels (EBFs). The additive may further have the characteristics of reducing friction, corrosion, and wear in internal combustion engines that run on EBFs. The fuel additive in accordance with the present invention is a formulation of hexylene glycol and boric acid. Minimization of phase separation and reduction of engine wear and degradation due to friction and deposit formation is expected to result in increased engine efficiency, extension of engine life, and reduction in repair and maintenance costs.

12 Claims, No Drawings

HEXYLENE GLYCOL FUEL ADDITIVE CONTAINING BORIC ACID FOR INHIBITING PHASE SEPARATION AND CORROSION IN ETHANOL BLENDED FUELS

CROSS REFERENCE TO RELATED APPLICATIONS

The present invention is related to U.S. patent application entitled, "USE OF HEXYLENE GLYCOL FUEL ADDITIVE CONTAINING BORIC OXIDE AS AN ENGINE LUBRICANT", filed on Mar. 15, 2012, and U.S. patent application entitled, "USE OF HEXYLENE GLYCOL ADDITIVE CONTAINING BORIC ACID FOR REDUCING FRICTION AND CORROSION IN INTERNAL COMBUSTION ENGINE CRANKCASES", filed on Mar. 15, 2012.

FIELD OF THE INVENTION

The present invention relates to fuel compositions, and more particularly to a novel fuel additive that inhibits and/or reverses phase separation in Ethanol Blended Fuels (EBFs) and reduces friction, corrosion and wear in internal combustion engines running on EBFs.

BACKGROUND OF THE INVENTION

Petroleum-based fuel prices in the United Sates continue to rise, causing economical pain to both businesses and consumers. Several reasons have been cited for the increasingly high prices seen at the gas pump. The United States continues to be one of the world's largest users of petroleum-based fuel. It is estimated the U.S. uses 18-20 million barrels of crude oil a day. As other countries such as China and India become more industrialized, they compete for oil, resulting in increases in the price of gas. Over the past several decades, the U.S. has steadily decreased its domestic production, creating increased dependency on foreign oil sources and fluctuating prices which are not always controllable. Exploring and drilling for new sources of domestic oil may be a mechanism to reduce the country's dependence on foreign oil. However, environmental concerns regarding the use of fossil fuels, i.e. increased levels of carbon dioxide emissions believed to contribute to the global warming phenomenon, have contributed to increased efforts for the development of alternative petroleum-based fuel sources.

Energy portfolios of the United States, as well as other industrialized nations, must be adapted to account for increased energy costs resulting from increased competition for limited resources as well as demand for cleaner fuels. Ethanol, an alcohol based, high octane renewable fuel made through fermentation and distillation of starch crops such as corn, has become an important part of the Untied States' energy portfolio. Ethanol provides an alternative fuel source which helps reduce dependency on foreign oil and reduces greenhouse emissions. It is estimated that greater than 80% of all retail gas stations across the United States use EBFs. Most commonly used in commercial settings is E10, a blend of 10% ethanol and 90% gasoline, or E85, a blend of 85% ethanol and 15% gasoline.

While the use of EBFs appear to provide a much needed alternative fuel source, acceptance of EBFs have not gained critical support because of several problems associated with their use. Although the problems associated with the use of ethanol can range from stability issues to being a strong solvent, one of the more concerning issues of EBFs is the problem associated with phase separation. Phase separation is the separation of the Ethanol/water phase and the gasoline phase. Phase separation results in degrading fuel performance, corrosion of engine and fuel system components, and increased noxious engine exhaust. If EBFs are to play a major role in reducing gasoline use, it is crucial that phase separation be eliminated or at least minimized.

Therefore, what is needed in the art is an EBF additive that reduces or minimizes phase separation. In addition, an EBF additive designed to prevent or minimize phase separation which reduces friction, corrosion and wear in internal combustion engines running on EBFs is also needed.

DESCRIPTION OF THE PRIOR ART

Several commercial products have been marketed for preventing phase separation in EBFs. These products have been developed to disperse and emulsify the water-ethanol phase back into the fuel in order to burn efficiently and safely through the engine. The known commercially available products typically contain alcohol compounds including isopropanol, n-butyl alcohol and other non-alcohol compounds such as hydrotreated naphthenic oil, petroleum distillates, and other trade secret dispersants. Additionally, use of boric acid has also been described in fuels and/or additive compositions. While the use of such materials has shown promise, engine oils or lubricants having boric acid form dispersions and/or emulsions as the boric acid or boric oxide is not easily or fully dissolved and tends to separate from the mixture. Use of a nanotechnology to decease the size of the boric acid particles have improved the separation problem, however, such techniques are time consuming, expensive, and still suffers from the possibility of particle separation.

U.S. Pat. No. 7,972,393 describes a multiphase distillate fuel composition. The composition includes an emulsion comprising a first phase comprising a diesel fuel, a second phase comprising glycerol and boric acid, and a surfactant.

U.S. Pat. No. 7,598,210 describes a lubricant composition for high temperature application. The lubricant contains a desirable combination of high temperature and oxidative stability. The lubricant composition includes a neopolyol ester, boron nitride powder, and a linker/surfactant.

U.S. Pat. No. 7,494,959 describes stable boric acid-containing lubricant compositions which are described as being capable of increasing the efficiency and performance of engines and other machines. The multiphase lubricant compositions are formed of an emulsion containing (a) a first phase comprised of the lubricant, (b) a second phase containing boric acid and a liquid, such as an organic liquid, that is a solvent for boric acid, but immiscible in the first phase, and (c) a surfactant. The liquid is described as being an organic liquid, such as a lower alkyl polyol, preferably glycerol, ethyl acetate, acetone, and alcohols such as methanol, ethanol, 1-propanol, 2-methyl-1-propanol, and 3-methyl-1-butanol or an inorganic liquid, such as glacial acetic acid or water, with glycerol being preferred.

U.S. Pat. No. 7,419,515 describes a multiphase distillate fuel composition comprising an emulsion containing a first phase comprised of a distillate fuel, a second phase, the second phase comprised of boric acid and an organic liquid that is a solvent for boric acid, but immiscible in the first phase, and a surfactant.

U.S. Pat. No. 6,645,262 describes liquid hydrocarbon fuel concentrates, including low sulfur liquid hydrocarbon fuel concentrates containing at least 5,000 ppm boric acid suspended in the liquid hydrocarbon fuel. Also disclosed are liquid hydrocarbon fuel compositions formed by diluting the concentrate to form compositions containing only from about 10 ppm to about 50,000 ppm boric acid as well as liquid hydrocarbon fuel compositions formed of a reaction product of boric acid having a particle size of about 65 microns or less, associated with a liquid hydrocarbon fuel having a monomer or prepolymer chemically grafted thereon.

U.S. Pat. No. 6,368,369 describes liquid hydrocarbon fuel concentrates containing from about 50,000 ppm to about 250,000 ppm particulate boric acid, based on the total weight of the concentrate, suspended in a liquid hydrocarbon fuel. The liquid hydrocarbon fuel is described as containing less than 500 ppm or less than 300 ppm sulfur, or even substantially no sulfur.

United States Patent Application 2011/0036262 describes structural coating comprising a liquid carrier, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application. The dynamic stabilization material creates a balance of stabilized material for supply of corrosion protection product, lubrication reduction product, and freezing point depression product.

United States Patent Application 2011/0015104 describes a composition including a lubricant comprising at least one of a hydrocarbon oil or grease, a surfactant, an ester of adipic acid, and a suspension of boric acid.

United States Patent Application 2007/0021310 describes structural coating comprising a polymeric resin, a borate-based additive, and a dynamic stabilization material. The borate-based additive is described as providing corrosion protection through electrochemical binding of active surface corrosive sites, lubrication enhancement through the creation and re-supply to a surface where friction contact occasionally occurs of a weak slip lane crystalline material which may be a locally formed product utilizing local atmospheric humidity, and a material for reaction with an initiator to provide for freezing point depression during coating application.

SUMMARY OF THE INVENTION

The present invention relates to a fuel additive formulation designed to inhibit and/or reverse phase separation in Ethanol Blended Fuels (EBFs). The additive may further have the characteristics of reducing friction, corrosion, and wear in internal combustion engines that run on EBFs. Reduction of engine wear and degradation due to friction and deposit formation results in 1) improved engine efficiency, 2) extension of engine life, and 3) reduction of repair and maintenance costs. The fuel additive in accordance with the present invention is a formulation of hexylene glycol and boric acid. The hexylene glycol acts as a solvent for the boric acid to provide a homogenous solution.

While the hexylene solution additive may be particularly useful in the marine industry, it may be used in fuel storage and delivery systems in which EBFs are exposed to ambient conditions of high humidity for extended periods of time or vehicles that are not used often. Since ethanol is hygroscopic and easily absorbs moisture from the air, any vehicle, marine or land-based, can be affected by water absorption. When water enters into the fuel tank containing EBFs, it is absorbed by the ethanol and continues to be absorbed until a saturation point is reached. Once the saturation point is reached, the ethanol-water mixture separates from the fuel, forming phase separation. Unlike the ethanol which is evenly dispersed in EBF, the ethanol in the phase separation is highly concentrated and can result in severe damage to the fuel system and the engine. Accordingly, phase separation can result in 1) the fuel tank or the fuel line being exposed to the corrosive ethanol, 2) deterioration of engine performance as a result of ethanol entering the engine from the bottom of the fuel tank, 3) acceleration of corrosion rate from impurities (water, oxygen, chloride, acetic acid) within EBFs resulting from greater exposure in the fuel system to the impurities which become dissolved in the phase separated ethanol, 4) incompatibility of EBFs with some polymers used in fuel systems, such as fiberglass fuel tanks used in boats, causing the polymers to swell and eventual reducing in tensile strength, tanks becoming porous, weak, unstable, and prone to leaking, and 5) increased fuel viscosity resulting in clogged fuel pumps as the polymers mixing with the ethanol.

Accordingly, it is an objective of the present invention to provide an Ethanol Blended Fuel source additive that reduces phase separation.

It is a further objective of the present invention to provide an Ethanol Blended Fuel source additive that reverses phase separation.

It is yet another objective of the present invention to provide an Ethanol Blended Fuel source additive that inhibits and/or reverses phase separation and reduces friction in internal combustion engines running on Ethanol Blended Fuels.

It is a still further objective of the present invention to provide an Ethanol Blended Fuel source additive that inhibits and/or reverses phase separation and reduces corrosion in internal combustion engines running on Ethanol Blended Fuels.

It is a further objective of the present invention to provide an Ethanol Blended Fuel source additive that inhibits and/or reverses phase separation and reduces wear in internal combustion engines running on Ethanol Blended Fuels.

It is a further objective of the present invention to provide a method of preventing or inhibiting phase separation in EBFs.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

While the present invention is susceptible of embodiment in various forms, there is described a presently preferred, albeit not limiting, embodiment with the understanding that the present disclosure is to be considered an exemplification of the present invention and is not intended to limit the invention to the specific embodiments illustrated.

The present invention is a fuel based additive containing EBF phase separation inhibition and/or reversal properties as well as antifriction and antiwear characteristics. The novel inhibitor of phase separation and corrosion in fuel sources comprises hexylene glycol and boric acid. The hexylene glycol/boric acid additive is preferably added to EBFs, such as E10 fuel. When added to the EBFs, the novel additive in accordance with the present invention has been shown to inhibit phase separation. In addition, the present invention has also been shown to reverse phase separation in EBFs. Moreover, the hexylene solution additive also provides a delivery mechanism for boron compound that protects and reduces friction and wear between metal surfaces in internal combustion engines. Accordingly, the novel EBF additive will increase engine performance and efficiency and reduce engine emissions, green house gases and other environmental pollutants.

Hexylene glycol, having the formula of $CH_3CH(OH)CH_2C(CH_3)_2OH$, and IUPAC name 2-methylpentane-2,4-diol is a member of the glycol family. While hexylene glycol has been used extensively in paints and cosmetics, use as a phase separator in ethanol-gasoline blends or as solvent for boric acid is not known. Several characteristic make it an ideal candidate for an environmentally friendly phase inhibitor in gasoline-ethanol blended fuels. It is a clear and odorless liquid at room temperature and has been determined to have low acute toxicity to mammals and aquatic organisms. It is fully miscible with water, ethanol, and gasoline and has less polarity than ethanol, allowing for better miscibility with gasoline as compared to ethanol. It is a viscous reducing agent and therefore will not increase the viscosity of the fuel. It is more hydroscopic than other common glycols. Other glycols are not known to be soluble in oil.

In a preferred embodiment of the present invention, the hexylene glycol additive solution further contains boric acid ($H_3BO_3$). Boric acid is an environmentally safe compound which has been found to have the capacity to enhance anti-friction and anti-wear properties of sliding metals. Boric acid is a crystalline compound which is insoluble in hydrocarbons and has been used as a lubricant. However, unlike use in previous lubricants where the boric acid formed a suspension, the hexylene glycol acts as a solvent for the boric acid so that the solvent and the solute are homogeneously mixed so that particle separation is prevented or minimized. Mixed in the right proportions, such as 0.1%-20% by weight boric acid, and more preferably from about 1-13%, and more preferably from about 1-4% by weight boric acid, with the hexylene glycol, the boric acid reacts chemically with metallic substrates to form a highly adhesive 0.5 micron thick crystal lattice structure of boric acid platelets that eliminates metal to metal contact, thereby resisting corrosion. The platelets align themselves parallel to the metal surface conforming to the direction of movement and resulting in decreased friction. If the boric acid film is scratched or sheared, it will immediately begin to self-renew in the presence of systemic moisture and oxygen. The solution may also contain additional components, including but not limited to a dispersant, such as Hypermer™ LP-1 dispersant designed for the wetting, dispersion and fluidisation of solid particles in non-aqueous systems (Croda International) to slow down precipitation for solutions under thermal conditions.

Example Pre Phase Separation-Hexylene Glycol Additive Solution: Boric acid powder, from about 1% to about 13% by weight, was dissolved in hexylene glycol at 150 degrees F. under high shear blending for about 15-30 minutes to form the hexylene glycol additive solution. An appropriate amount of hexylene glycol additive solution to prevent and/or inhibit phase separation is added to the fuel storage and/or the fuel delivery system of a marine boat containing ethanol-blended fuel, such as E10, which has not undergone a phase separation. When added to the fuel storage tank, phase separation was prevented.

Example Post Phase Separation-Hexylene Glycol Additive Solution Boric acid powder, from about 1% to about 13% by weight, was dissolved in hexylene glycol at 150 degrees F. under high shear blending for about 15-30 minutes to form the hexylene glycol additive solution. An appropriate amount of hexylene glycol additive solution to prevent and/or inhibit phase separation is added to the fuel storage and/or the fuel delivery system of a marine boat containing ethanol-blended fuel, such as E10, which has undergone a phase separation. When added to the fuel storage tank, phase separation was reversed.

Example Hexylene Glycol Additive Solution/Liquid Hydrocarbon Fuel: Boric acid powder, from about 1% to about 13% by weight, was dissolved in hexylene glycol at 150 degrees F. under high shear blending for about 15-30 minutes to form the hexylene glycol additive solution. The hexylene glycol additive solution was then added to ethanol-blended fuel, such as E10, and mixed until a homogenous solution was formed. The hexylene glycol additive solution/liquid hydrocarbon fuel source was then placed in a marine vessel in order to prevent and/or reverse phase separation.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A fuel additive formulation consisting of a solution of hexylene glycol and boric acid, said boric acid having a concentration of between 1% and 13% by weight.

2. A fuel additive formulation comprising hexylene glycol, boric acid having a concentration of between 1% and 13% by weight and an ethanol blended fuel containing at least 10% ethanol.

3. A method of preventing phase separation in ethanol blended fuels comprising the steps of:

providing a fuel additive formulation consisting of a solution of hexylene glycol and boric acid, said boric acid having a concentration of between 1% and 13% by weight, said engine additive fuel formulation formulated to inhibit or reverse phase separation in ethanol blended fuels and enhance anti-friction and anti-wear properties; and applying said fuel additive formulation to a vehicle having a fuel storage and delivery system which contains ethanol blended fuels.

4. The method of preventing phase separation in ethanol blended fuels according to claim 3 wherein the step of providing a fuel additive formulation consisting of a mixture of hexylene glycol and boric acid to a vehicle having a fuel storage and delivery system which uses ethanol blended fuels occurs prior to formation of phase separation.

5. The method of preventing phase separation in ethanol blended fuels according to claim 3 wherein the step of providing a fuel additive formulation consisting of a mixture of hexylene glycol and boric acid to a vehicle having a fuel storage and delivery system which uses ethanol blended fuels occurs after formation of phase separation.

6. The method of preventing phase separation in ethanol blended fuels according to claim 3 wherein said vehicle is an automobile.

7. The method of preventing phase separation in ethanol blended fuels according to claim 3 wherein said vehicle is a marine vehicle.

8. A method of preventing phase separation in ethanol blended fuels comprising the steps of: providing a fuel additive formulation consisting of a solution of hexylene glycol, boric acid in a concentration of between 1% and 13% by weight and ethanol blended fuel, said engine additive fuel formulation formulated to inhibit or reverse phase separation in ethanol blended fuels and enhance anti-friction and anti-wear properties; and applying said fuel additive formulation to a vehicle having a fuel storage and delivery system which uses ethanol blended fuels.

9. The method of preventing phase separation in ethanol blended fuels according to claim 8 wherein said ethanol blended fuel contains at least 10% ethanol.

10. The method of preventing phase separation in ethanol blended fuels according to claim 8 wherein said ethanol blended fuel is ethanol and gasoline.

11. The method of preventing phase separation in ethanol blended fuels according to claim 8 wherein said vehicle is an automobile.

12. The method of preventing phase separation in ethanol blended fuels according to claim 8 wherein said vehicle is a marine vehicle.

* * * * *